United States Patent [19]

Slavin et al.

[11] 4,387,788

[45] Jun. 14, 1983

[54] DIAPHRAGM PRESSURE RING FOR TONE GENERATORS

[75] Inventors: Michael Slavin, Troy; Irvin B. Rea, Royal Oak, both of Mich.

[73] Assignee: Lectron Products, Inc., Rochester, Mich.

[21] Appl. No.: 341,442

[22] Filed: Jan. 21, 1982

[51] Int. Cl.[3] ..... H04R 7/00

[52] U.S. Cl. ..... 181/171; 181/148; 179/115 R; 179/115.5 ES

[58] Field of Search ..... 181/148, 171, 172, 179; 179/115 R, 115.5 ES

[56] References Cited

U.S. PATENT DOCUMENTS 4,056,697 11/1977 Heil ..... 181/171 X 4,284,857 8/1981 Slavin et al. ..... 179/115 R

*Primary Examiner*—Benjamin R. Fuller

*Attorney, Agent, or Firm*—Harness, Dickey & Pierce

[57] ABSTRACT

A molded pressure ring adapted primarily for holding the peripheral marginal portion of a diaphragm in a tone generator under uniform light pressure so that the tone does not change significantly under normal changes in ambient conditions of temperature and pressure; more particularly the ring comprises an outer annular body having circumferentially equi-spaced, radially inwardly extending, generally U-shaped, independently movable, flexible and resilient cantilevers provided at the free ends thereof with pressure applicators arranged to engage and hold the diaphragm under pressure exerted by torsion-stressed portions of the cantilevers.

7 Claims, 6 Drawing Figures

DIAPHRAGM PRESSURE RING FOR TONE GENERATORS

FIELD OF THE INVENTION

This invention relates to new and useful improvements in tone generators and more particularly to a novel form of pressure ring for holding the diaphragm that produces the tone.

DESCRIPTION OF THE PRIOR ART

Although not limited to use with the particular construction of tone generator covered by the copending application Ser. No. 57,516, filed July 13, 1979, now U.S. Pat. No. 4,284,857, and owned by the assignee of this patent application, the diaphragm pressure ring of this invention was developed particularly to replace the foam gasket 26 shown in FIG. 1 of the prior application. While the foam gasket 26 serves its intended purpose very well when properly formed and assembled with the other components of the tone generator, it sometimes becomes torn or mashed out of shape during shipment and, when this happens, the gasket becomes difficult to handle particularly in automatic assembly operations.

BRIEF SUMMARY OF THE INVENTION

The diaphragm or pressure ring of the present invention can be molded relatively inexpensively in one piece from a suitable plastic resin material and it is uniquely formed to replace not only the gasket 26 but also the retainer ring 28 used in the prior construction referred to above. Thus, the instant one-piece pressure ring replaces two elements of the prior assembly and consequently simplifies the assembly of the tone generator to some extent and thus adapts the operation for better automatic assembly. Furthermore, the one-piece pressure ring of this invention is relatively strong so that it holds its shape and does not tend to get torn, broken or mashed as did the relatively light and readily destructible foam gasket in the prior construction. Moreover, the instant pressure ring holds and retains the seated marginal edge portion of the diaphragm under constant light pressure in such a way that the tone produced by the diaphragm does not change significantly under normal variations in temperature and pressure to which the tone generator is subjected in use. The pressure ring of this invention appears to have greater temperature stability than the previous construction so that it achieves a more constant tone output under all normal variations in temperature and pressure. Additionally, the optimum pressure exerted against the seated marginal edge of the diaphragm by the pressure ring of this invention can be maintained for a longer time than is possible when the previous foam gasket and retainer ring construction is used. These are important factors since tone generators of the type involved here ideally should last for the life of the automotive vehicle of which it is a part, and a constant tone for the generator can be achieved only if the seating pressure against the diaphragm is constant over this period of time. If the seating pressure against the diaphragm increases for any reason, the tone created by the generator varies excessively with normal changes in ambient temperature and if the seating pressure becomes substantially less than the original optimum pressure the diaphragm will not produce the desired true tone.

DESCRIPTION OF THE PREFERRED EMBODIMENT

As suggested, the diaphragm pressure ring of this invention is adapted primarily for use with a tone generator of the type disclosed in the prior application although it obviously has general utility and can be used with or readily adapted for other types and kinds of tone generators and other devices. To this end, the diaphragm pressure ring is shown, by way of example, on and in operative association with the tone generator disclosed in the application and patent referred to above. However, only portions of the tone generator necessary to show an environment for the pressure ring are here shown, and the entire disclosure of the U.S. Pat. No. 4,284,857 incorporated herein by reference for a more complete showing and understanding of the environment. To this end, the same numbers are used in this application as in the U.S. Pat. No. 4,284,857 to designate corresponding parts of the tone generator.

Figure 1:
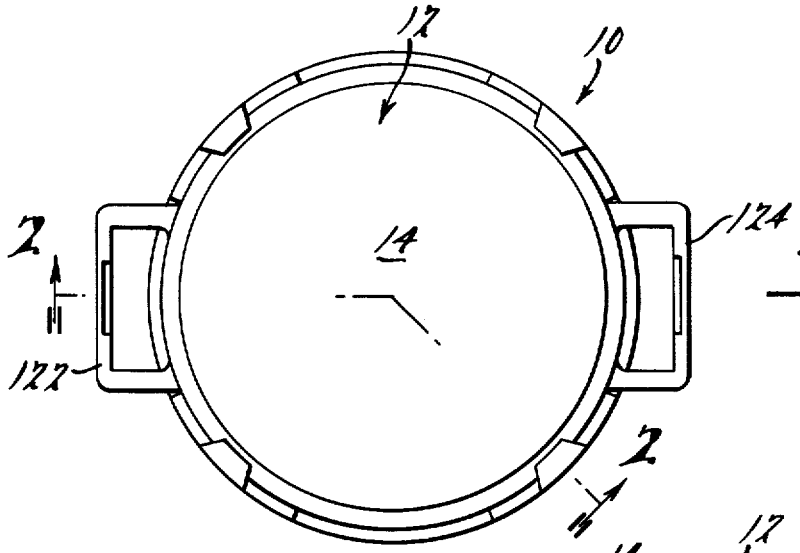
FIG. 1 is a rear plan view showing a diaphragm pressure ring embodying the present invention mounted on a tone generator housing of the type disclosed in the prior application referred to above.
Figure 2:
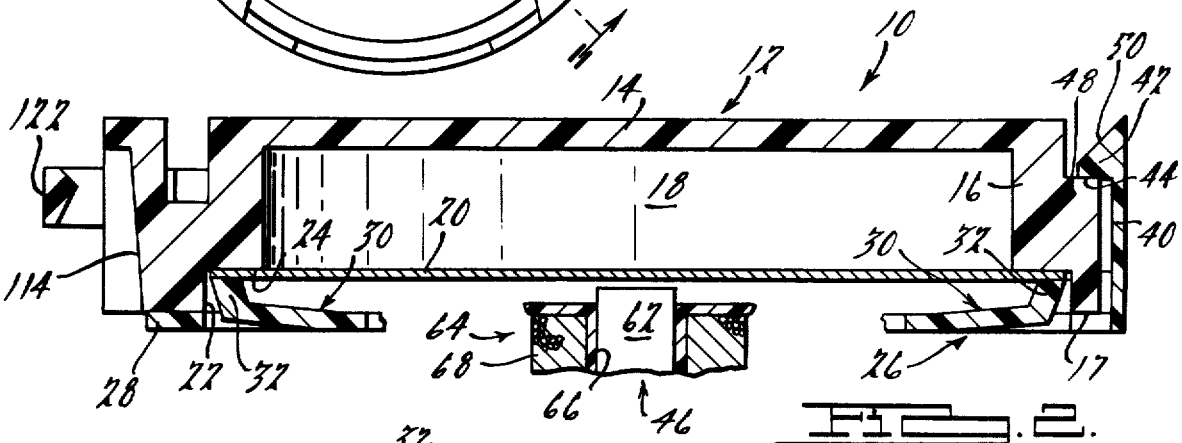
FIG. 2 is a vertical sectional view taken on the line 2—2 of FIG. 1 and further illustrating the manner in which the pressure ring of this invention holds the marginal edge portion of the diaphragm against an annular seating surface provided by the housing.
Figure 3:
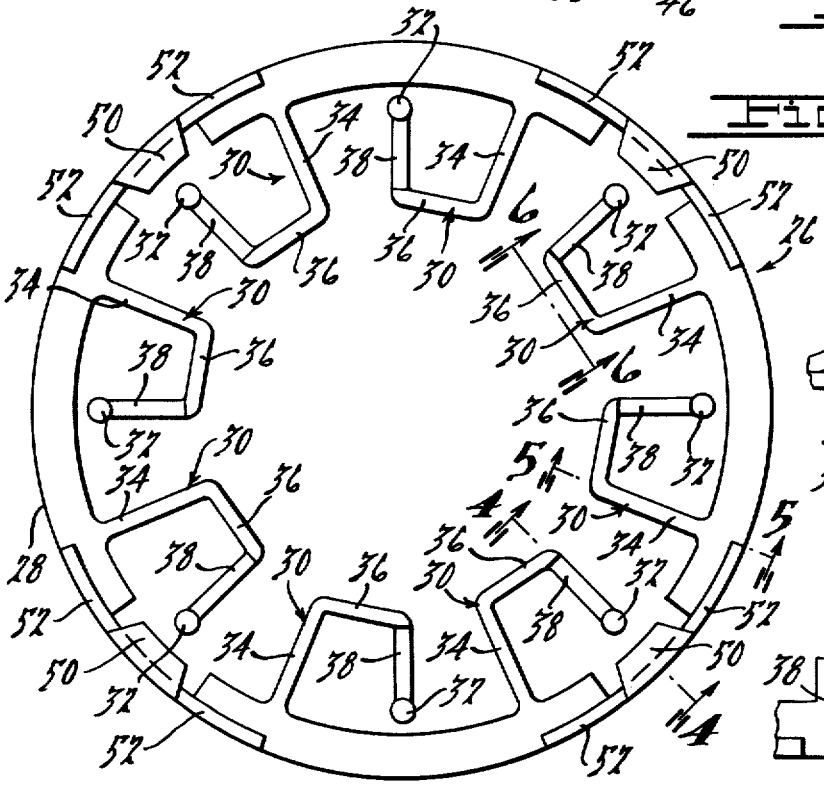
FIG. 3 is an enlarged plan view of the pressure ring looking at the underside thereof.
Figure 4:
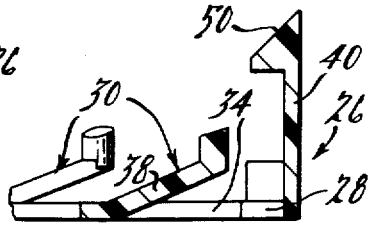
FIG. 4 is a fragmentary, radial sectional view taken on the line 4—4 of FIG. 3.
Figure 5:
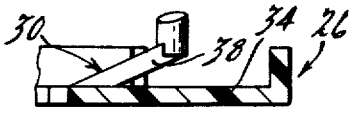
FIG. 5 is a fragmentary, radial sectional view taken on the line 5—5 of FIG. 3.
Figure 6:
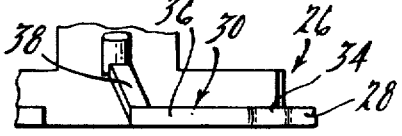
FIG. 6 is a fragmentary view looking in the direction of the arrows 6—6 in FIG. 3.

More particularly, the tone generator here shown has a sound transducer sub-assembly 10 that comprises a shallow, generally cup-shaped body or casing 12 having a flat disk shaped bottom 14 and a surrounding peripheral wall 16 that defines a sound cavity 18 which is closed by a metallic diaphragm 20 that is suitably detachably fastened to the body. As perhaps best shown in FIG. 2, the peripheral wall 16 is formed radially inwardly from and behind the outer or free edge 17 thereof with an annular recess 22 having an outwardly facing, radially extending, annular shoulder 24 on which the outer annular marginal edge portion of the dipahragm 20 seats. The sound transducer sub-assembly 10 is adapted to be mounted on the spaced parallel arms (not shown) of a suitable pole piece a fragmentary portion of which is shown at 46. In this latter connection, the pole piece is provided intermediate the spaced arms referred to above with a coil mounting member 62 that terminates below but in close proximity to the center of the diaphragm 20 when the sound transducer sub-assembly 10 is mounted on the pole piece with the spaced arms of the latter disposed in upwardly tapered slots 114 at opposite sides of the body 12 and detachably engaged in snap fastening relation with straps 122 and 124 that are formed on the housing at diametrically opposite sides thereof, as perhaps best shown in FIG. 1. In practice, an electromagnetic coil 64 is mounted on the coil mounting member 62 and the coil conventionally comprises a spool 66 which carries a wrapping or coil of wire 68. When energized, the electromagnetic coil 64 causes the metallic diaphragm 20 to vibrate resulting in the desired sound or tone.

In order to produce an essentially constant tone within the range of ambient temperature and pressure conditions to which the tone generator normally is exposed and subjected in use, it is essential that the seated marginal edge portion of the diaphragm 20 be held against the seat 24 with uniform light pressure, If the seated portion of the diaphragm 20 is held too tighly or with too much pressure, the tone varies excessively with normal changes in ambient temperature. On the other hand, if the diaphragm 20 is held too loosely or with too light a pressure, the entire diaphragm moves when excited and vibrated by the electromagnetic coil 64 and the desired sound or tone is not achieved at all.

According to the present invention, the seated marginal edge portion of the diaphragm 20 is held with requisite optimum light pressure by a pressure ring designated generally by the numeral 26 that preferably is formed in one piece of a suitable plastic resin material. Any plastic resin material that is suitably strong and tough and that does not change its shape or size under changes in ambient temperatures to which it is or may be exposed in use can be used. An acetal homopolymer marketed under the name Del-Rin has been found to be most suitable for this purpose.

The pressure ring 26 has an annular, ring-shaped body portion 28 of a size and shape to overlay and seat flatly against the outer edge 17 of the housing 12, a plurality of circumferentially spaced cantilevers 30 on the body 28 at the inner side thereof, and pressure applicator members 32 on the inner free ends of the cantilevers that bear on and press against the seated marginal edge portion of the diaphragm 20. As best shown in FIGS. 3–6, the cantilevers 30 are generally U-shaped in plan, and each cantilever is capable of flexing independently of the others. Each cantilever 30 here shown has a similar pressure applicator 32, and the cantilevers are spaced sufficiently close together so that the pressure applicators contact the marginal edge portion of the diaphragm 20 at relatively closely spaced points. As will be apparent, all of the pressure applicators 32 lie in a generally circular path of a diameter that positions them directly over the shoulder 24 and in contact with the diaphragm substantially equi-distantly from the center thereof.

Each cantilever 30 includes an inner arm portion 34 that preferably is formed integrally with the body portion 28 and extends radially inwardly therefrom, an intermediate or middle arm portion 36 that extends generally circumferentially with respect to the body 28 and spaced radially inwardly therefrom, and an outer arm portion 38 that extends radially outwardly from the intermediate arm portion 36 in generally parallel relation to but in slightly outwardly divergent relation with respect to the inner arm portion 34. As shown in the drawing, the outer arm portion 38 terminates short of the surrounding body member 28 so that the pressure applicator 32 at the free end of the outer arm portion also is spaced from the body member. All of the cantilevers 30 are identically formed and all of the pressure applicators 32 extend axially in the same direction from the outer arm portions 38 to which they are attached and of which they are a part. The inner and intermediate arm portions 34 and 36 of each cantilever 30 preferably lies in substantially the same plane as the surrounding body member 28, but the outer arm portion 38 of each cantilever is bent or inclined axially sufficiently from the plane of the body member, as shown in FIGS. 2 and 4–6, so that when the body member 28 is pressed flatly against the end 17 of the body 12 the pressure applicators 32 engage the diaphragm before the body member contacts the edge 17. Thus, the outer arm portions 38 are flexed axially toward the plane of the body member 28 from substantially the position shown in FIG. 4 to substantially the position shown in FIG. 2 as the body member moves toward and into engagement with the edge surface 17. However, in addition to the axial flexing movement of the outer arm portions 38, the inner and intermediate arm portions 34 and 36 are both deflected axially to some extent and torsionally stressed as well. Thus, the axial flexing of the arm portions and the torsional stressing of the inner and intermediate arm portions 34 and 36 particularly combine and mutually augment each other to press the pressure applicators 32 against the diaphragm 20. The manner in which the combined pressures exerted by all of the cantilevers 30 are available and utilized to press the marginal edge portion of the diaphragm 20 against the seat 24 have been found to be particularly effective in holding the diaphragm properly with optimum pressure. The combined pressure exerted against the seated marginal edge portion of the diaphragm 20 exerted by all of the independently stressed cantilevers 30 hold the diaphragm firmly so that only the center portion of the diaphragm is vibrated in use but the seating pressure is sufficiently light so that the tone generated by the diaphragm does not vary significantly under any normal condition of temperature and pressure to which the tone generator is or may be subjected in use.

Any desired number of the cantilevers 30 may be provided, but it will be readily apparent that the number required in any particular instance may well vary depending on the size of the pressure ring 26 and the amount of pressure required in use. In the particular environment shown, a pressure ring 26 made from 0.030" thick Del-Rin and about 1¾" in diameter required 8 of the cantilevers 30.

In the particular environment here shown, the means for holding the pressure ring 26 assembled on the housing 12 comprises four equi-spaced arm members 40 formed integrally with and extending axially in the same direction from the body member 28 in the same direction as the pressure applicators 32. The fastening members 40 extend along the peripheral wall 16 of the housing 12 and are formed at the ends thereof with head portions 42 defining radial shoulders 44 that face in the direction of the body 28 and are disposed to overlap and seat against a rearwardly facing annular ledge or seat 48 on the wall 16 when the body member 28 is seated on the free edge 17 of the wall, as shown in the drawing. The head portions 42 also preferably are formed with tapered outwardly and rearwardly beveled surfaces 50 that engage the forward edge of the wall 16 when the pressure ring 26 is pushed thereagainst to seat the annular body member 28 against the surface 17. As the pressure ring 26 is pushed toward the body 12 at assembly, the beveled surfaces 50 wedge against the outer edge of the surface 17 and flex the fastening arms 40 radially outwardly so that the head portions 42 slide along the outer peripheral surface of the wall 16. The shoulders 44 reach a position where they can just overlap the ridge 48 at the same time the body member 28 engages the seating surface 17, and the resilient action of the arms 40 causes the shoulders 44 to move radially inwardly in detachable interlocking engagement with the ledge 48 as the body member 28 reaches its final seating position. If necessary or desirable, each of the fastening arms 40 can be provided adjacent the base and at opposite sides thereof with reinforcing flanges 52 that stiffen the same so as to enhance the holding action of the arms after assembly. Manifestly, the tapered wedging surfaces 50 also permit the fastening arms 40 to be readily flexed manually outwardly to permit easy disengagement of the pressure ring 26 from the housing 12.

It will be readily appreciated that the fastening means 40 here shown and described eliminates one of two parts required by the previous construction referred to above and, to this extent, they facilitate and expedite assembly of the pressure ring on the housing 12. Also, the one-piece molded plastic composition of the pressure ring 26 causes it to hold its shape during shipment and handling and it also particularly and uniquely adapts the ring for automatic assembly thus minimizing to some extent at least handling and assembly costs in the manufacture of the tone generator.

Having thus described the invention, we claim:

1. A diaphragm pressure ring for tone generators of the type having a housing provided with a sound cavity, an annular supporting surface adjacent to said cavity, and a diaphragm closing said cavity disposed with the outer marginal portion thereof seated on said supporting surface, said ring comprising an annular member, a plurality of flexible and resilient cantilevers on said annular member, and pressure applicator members on the free ends of said cantilevers, said cantilevers being spaced substantially equidistantly around and disposed substantially in the same plane as and at one side of said annular member, said pressure applicators extending axially in the same direction from said cantilevers and collectively lying in a circular path of substantially the same diameter as said supporting surface; and means for fastening the annular member of said pressure ring to the tone generator housing with said cantilevers disposed free from engagement with said housing and said diaphragm with said pressure applicator members overlying and in pressed engagement with the seated marginal portion of said diaphragm and with said cantilevers stressed to maintain said pressed engagement.

2. The diaphragm pressure ring defined by claim 1 wherein said cantilevers are substantially U-shaped and arranged to position said pressure applicator members relatively close to but spaced radially from said annular member.

3. The diaphragm pressure ring defined by claim 1 wherein said annular member is of substantially the same diameter as said supporting surface and wherein said cantilevers and said pressure applicator members are disposed at the inner side of said annular member.

4. The diaphragm pressure ring defined by claims 1, 2 or 3 wherein each of said cantilevers has interconnected torsion arm portions angularly related with respect to each other and collectively disposed to be torsionally stressed when said annular member is fastened to said housing.

5. The diaphragm pressure ring defined by claims 1, 2 or 3 wherein each of said cantilevers comprises interconnected torsion arm portions angularly related with respect to each other and disposed in such relation to said ring as to be torsionally stressed when the latter is fastened to said housing, at least one torsion arm portion of each cantilever being disposed substantially radially with respect to said annular member and at least one other torsion arm portion of each cantilever being disposed substantially parallel to said annular member and substantially at right angles to said one torsion arm portion.

6. The diaphragm pressure ring defined by claims 1, 2 or 3 wherein each of said cantilevers has interconnected torsion arm portions angularly related with respect to each other and collectively disposed to be torsionally stressed when said annular member is fastened to said housing, and wherein said fastening means comprises flexible and resilient members on and extending axially from said ring, said flexible and resilient members having snap fastener portions adapted for detachable engagement with some predetermined portion of said tone generator housing.

7. The diaphragm pressure ring defined by claims 1, 2 or 3 wherein each of said cantilevers comprises interconnected torsion arm portions angularly related with respect to each other and disposed in such relation to said annular member as to be torsionally stressed when the latter is fastened to said housing, at least one torsion arm portion of each cantilever being disposed substantially radially with respect to said annular member and at least one other torsion arm portion of each cantilever being disposed substantially parallel to said annular member and substantially at right angles to said one torsion arm portion, and wherein said fastening means comprises flexible and resilient members on and extending axially from said annular member, said flexible and resilient member having snap fastener portions adapted for detachable engagement with said tone generator housing.

* * * * *